US006458756B1

(12) United States Patent
Karpusiewicz et al.

(10) Patent No.: US 6,458,756 B1
(45) Date of Patent: Oct. 1, 2002

(54) POWDER DETERGENT PROCESS

(75) Inventors: William Karpusiewicz, Washingtonville, NY (US); Roy Dennis Ray, Cartersville, GA (US); Philip Glassman, Monroe, CT (US)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 30 days.

(21) Appl. No.: 09/593,841

(22) Filed: Jun. 14, 2000

Related U.S. Application Data

(60) Provisional application No. 60/143,904, filed on Jul. 14, 1999.

(51) Int. Cl.[7] ..... C11D 11/00

(52) U.S. Cl. ..... 510/444; 510/101; 510/276; 510/441; 23/313 FB

(58) Field of Search ..... 510/276, 444, 510/441, 101; 23/313 FB

(56) References Cited

U.S. PATENT DOCUMENTS

| | | | | |
|---|---|---|---|---|
| 2,825,190 A | | 3/1958 | Heald | |
| 3,573,091 A | | 3/1971 | Waldman et al. | |
| 3,614,880 A | | 10/1971 | Bayne et al. | |
| 3,668,905 A | | 6/1972 | Schlunke | |
| 3,776,763 A | | 12/1973 | Ross | |
| 3,776,773 A | | 12/1973 | Taft | |
| 3,819,526 A | * | 6/1974 | Pierce et al. | 510/441 |
| 3,925,226 A | | 12/1975 | Takenouchi et al. | |
| 4,006,110 A | | 2/1977 | Kenney et al. | 252/540 |
| 4,077,891 A | | 3/1978 | Beimesch et al. | |
| 4,139,475 A | | 2/1979 | Schwadtke et al. | |
| 4,141,316 A | | 2/1979 | Grun | |
| 4,153,201 A | | 5/1979 | Berger et al. | |
| 4,236,320 A | | 12/1980 | Schwadike et al. | |
| 4,252,844 A | | 2/1981 | Nesgood et al. | |
| 4,272,385 A | | 6/1981 | Crete et al. | |
| 4,301,968 A | | 11/1981 | Berger et al. | |
| 4,337,896 A | | 7/1982 | Berger et al. | |
| 4,352,459 A | | 10/1982 | Berger et al. | |
| 4,448,818 A | | 5/1984 | Hartog et al. | |
| 4,466,897 A | | 8/1984 | Appel et al. | |
| 4,526,808 A | | 7/1985 | Strohmaier | |
| 4,541,564 A | | 9/1985 | Berger et al. | |
| 4,642,581 A | | 2/1987 | Erickson | |
| 4,647,471 A | | 3/1987 | Jenkins | |
| 4,655,393 A | | 4/1987 | Berger | |
| 4,721,633 A | | 1/1988 | Baldassin | |
| 4,723,708 A | | 2/1988 | Berger et al. | |
| 4,753,843 A | | 6/1988 | Cook et al. | |
| 4,882,204 A | | 11/1989 | Tenenbaum | |
| 4,940,584 A | | 7/1990 | Tararuj et al. | |
| 4,978,067 A | | 12/1990 | Berger et al. | |
| 5,000,978 A | | 3/1991 | Davidson et al. | |
| 5,219,120 A | | 6/1993 | Ehrenberg et al. | |
| 5,523,112 A | | 6/1996 | Carns et al. | |
| 5,538,754 A | | 7/1996 | Sandock | |
| 5,565,420 A | * | 10/1996 | Stearns | 510/358 |
| 5,723,427 A | * | 3/1998 | Scherr et al. | 510/361 |
| 5,753,302 A | | 5/1998 | Sun et al. | |
| 5,885,952 A | * | 3/1999 | Kuratli et al. | 510/340 |
| 6,156,120 A | * | 12/2000 | Heffels et al. | 118/56 |

FOREIGN PATENT DOCUMENTS

| | | |
|---|---|---|
| EP | 582 478 | 2/1994 |
| GB | 748780 | 5/1953 |
| WO | 92/06163 | 4/1992 |
| WO | 93/21292 | 10/1993 |

OTHER PUBLICATIONS

Derwent Abstract SU 1804475, published Mar. 23, 1993.

* cited by examiner

*Primary Examiner*—Lorna M. Douyon
(74) *Attorney, Agent, or Firm*—Rimma Mitelman

(57) ABSTRACT

A process for applying relatively volatile ingredients, such as perfume, to powdered detergents minimizes the loss of the ingredients to the atmosphere and increases plant efficiency.

5 Claims, 5 Drawing Sheets

POWDER DETERGENT PROCESS

PRIORITY

This application claims priority to provisional application No. 60/143,904 filed Jul. 14, 1999.

BACKGROUND

Powdered detergents are well known commercial products in the laundry care industry. Detergents sold under the brand names Wisk (Unilever) and Tide (Procter & Gamble) have been available for many years.

Processes for manufacturing powdered detergents are also well known. In a typical process, a base powder formulation is passed through several steps wherein one or more agents are added. These agents can include, for example, perfumes, enzymes and colorants. It is not uncommon for commercial detergents that are marketed and sold under different brand names to have a common base powder, yet be different because they have different agents or additives. For example, brand A may have perfume X and enzyme Y, while brand B has perfume Z and no enzyme. It is also not uncommon for a single plant to be used to make several brands, even though those brands are unique. This can present scheduling issues because, for purposes of safety and quality control, it must be ensured that there is no cross contamination between the brands.

When processing powdered detergents, it has been found that a significant amount of agents can be lost prior to final packaging, particularly volatile agents such as perfumes. This is generally due the type of processes through which the powdered detergent is passed and the manner in which agents are applied to the base powder.

With reference to FIG. 1, a prior art process for manufacturing powdered detergents is shown. Base powder 100 flows from storage vessel 10 onto weigh feeder 20. Belt 22 moves the powder across weigh feeder 20, causing base powder 100 to cascade off belt 22 into vessel 30. Flow rates of base powder 100 can range from about 15,000 lbs/hr to about 100,000 lbs/hr. As powder 100 falls towards vessel 30, pressurized spray system 40 sprays liquid perfume P onto the powder, designated as powder 100P in vessel 30. Spray system 40 can include tank 42 containing perfume P, pressure pump 44 and spray nozzle 46. The rate of perfume application from pressurized spray system 40 is coordinated with the rate of flow of powder to ensure uniform dosing. Levels of perfume in the final product is typically in the range of from about 0.1 wt % to about 0.5 wt %.

From vessel 30, powder 100P is transferred to post dosing belt 50, wherein belt 50 further transfers the perfumed powder towards mixer 60, which is preferably a fluidized bed. Prior to entering mixer 60, various miscellaneous agents M2, M4 and M6 are added to powder 100P via vessels 62, 64 and 66, respectively. Agents that can be added to the powder moving along post dosing belt 50 include enzymes, colorants, sulfates, carbonates and other known additives. Typically, between 5 wt % and 25 wt % of the final powder composition can be added in this process. After addition of the miscellaneous agents, the powder is mixed in mixer 60 to ensure uniformity and is designated as 100P+M.

After mixer 60, powder 100P+M is transferred to vessel 70. Vessel 70 is preferably a hopper and serves to transfer powder 100P+M to one or more weigh flasks 80. The weigh flasks then gravity dispense a known quantity of powder (based on a weight measurement) 100P+M into suitable containers 90, such as boxes, bottles, buckets or bags.

Several inefficiencies can be identified with the process of FIG. 1, all relating to the application of perfume between weigh feeder 20 and vessel 30. First, the relatively high rate of powder flow from weigh feeder 20 requires a correspondingly high rate of flow of perfume from pressurized spray system 40. This can result not only in inefficient and uneven application of the perfume that can further result in clumps of powder 100P, but misapplied spray can accumulate on belt 22, hopper 30 and other equipment in the area. Second, when powder 100P travels along post dosing belt 50, at least some quantity of perfume volatilizes. Third, when powder enters mixer 60, the action within the mixer causes further loss of perfume, particularly if fluidized bed technology is utilized. Fourth, because between about 5 wt % to about 25 wt % of the final product is added after application of the perfume, the amount of perfume, on a weight percent (wt %) basis is higher for powder 100P than for powder 100P+M. This tends to exacerbate the above-identified inefficiencies. Fifth, when production of a first variant having a first perfume is complete and a second variant with a second perfume is to be manufactured, the production line must be cleaned from weigh feed 20 forward. Similarly, because the perfume is introduced early in the process and is able to enter the atmosphere at several steps, it is generally not possible to simultaneously run other variants in the same plant, for purposes of quality control. Lastly, losing perfume to the atmosphere results in economic and environmental costs.

Therefore, there is a need for an improved powdered detergent manufacturing process wherein the loss of perfume and other volatile actives during the process of making the powder is minimized. There is also a need to ensure uniformity of the final packaged product. There is a further need to increase plant efficiency.

Perfume agents can be classified by their relative volatility. High volatile perfumes are also known as "high notes" while relatively non-volatile perfume are also known as "low notes." High note perfumes are typically more perceptible by humans than low note perfumes, which is believed to be due to their high volatility. Known high notes also have a wider range of odors and, therefore, allow for greater flexibility when selecting perfume agents. Unfortunately, when manufacturing powdered detergents, it is the desired high notes that are typically lost during processing. This has resulted in a decreased amount of high note perfumes being used and, if used, less make it into the packaged product.

Therefore, there is also a need for a powdered detergent manufacturing process that would allow for increased usage of high note perfumes, wherein the highly volatile perfumes are retained in the powder so as to reach the consumer.

SUMMARY

The present disclosure relates to a process which minimizes the loss of perfume and other volatile agents during the fabrication of powdered detergents. It has been found that it is possible to rearrange the order of addition or inclusion of volatile agents from one or more of the manufacturing process steps. More specifically, by adding the perfume and/or other volatile agents closer to the step of packaging, there is less loss of the perfume to the atmosphere during the process. In the case of perfumes, the perfume profile remains relatively unaltered and a wider variety of perfumes can be used.

DETAILED DISCRIPTION

For simplicity, "perfume" will be used herein to describe an ingredient that can volatilize in an undesirable manner. It is within the scope of the present disclosure, however, that other volatile agents can be advantageously applied by the presently disclosed process. These agents can include, for example, water, surfactants, dye transfer inhibitors, hygene agents and other volatile agents.

Figure 1:
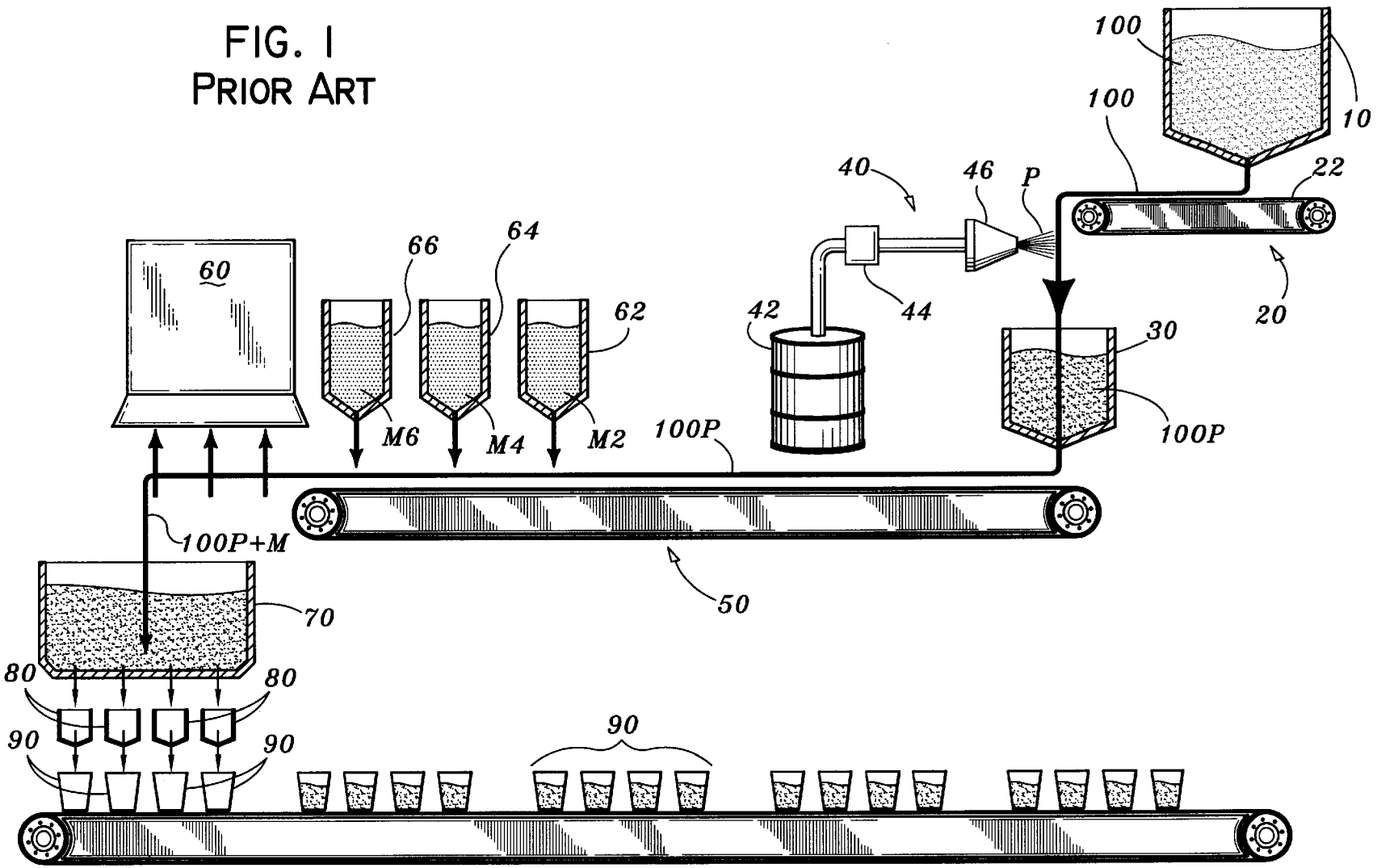
FIG. 1 PRIOR ART
FIG. 1 illustrates a prior art powdered detergent manufacturing process.
Figure 2:
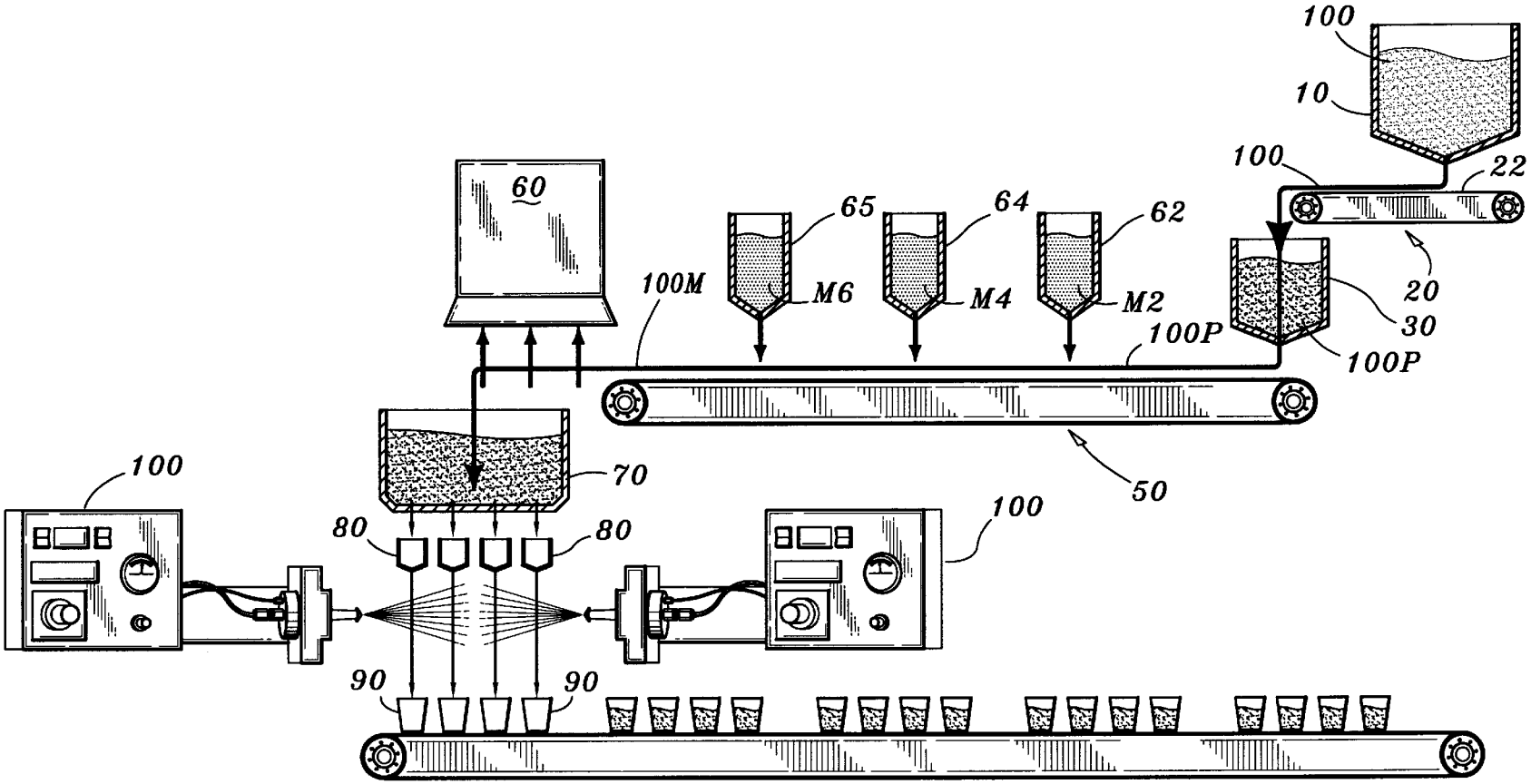
FIG. 2 illustrates an improved powdered detergent manufacturing process.

With reference to FIG. 2, a process is shown that is similar to that in FIG. 1. The primary modification illustrated in FIG. 2 is the elimination of the step of applying perfume prior to mixer 60. More specifically, perfume applicator system 40 has been eliminated. Subsequent to mixer 60, however, the perfume is now applied using perfume system 100. Perfume system 100 applies perfume P to powder 100M just prior to packaging. As shown, powder 100M exits vessel 70 and enters weigh flask 80. In a preferred process, weigh flasks 80 are filled with an amount of powder that corresponds to a predetermined weight amount. Alternatively, volumetric measurement can be used. After the proper amount of powder has entered flasks 80, the flasks open to release the powder into containers 90. As shown, the perfume is preferably applied to the powder between flasks 80 and containers 90. However. it is within the scope of the present disclosure that perfume can be applied at any point subsequent to mixer 60, i.e., prior to vessel 70 or prior to weigh flasks 80. Referring back to FIG. 2, the preferred method of applying the perfume is through spray application. In a most preferred method, ultra-sonic spray applicators are utilized, such as those available from Sono-Tek Corporation located in Milton, N.Y. Pilot tests of the above-described process and apparatus of FIG. 2 have produced commercially acceptable perfumed powdered detergent product.

Figure 3:
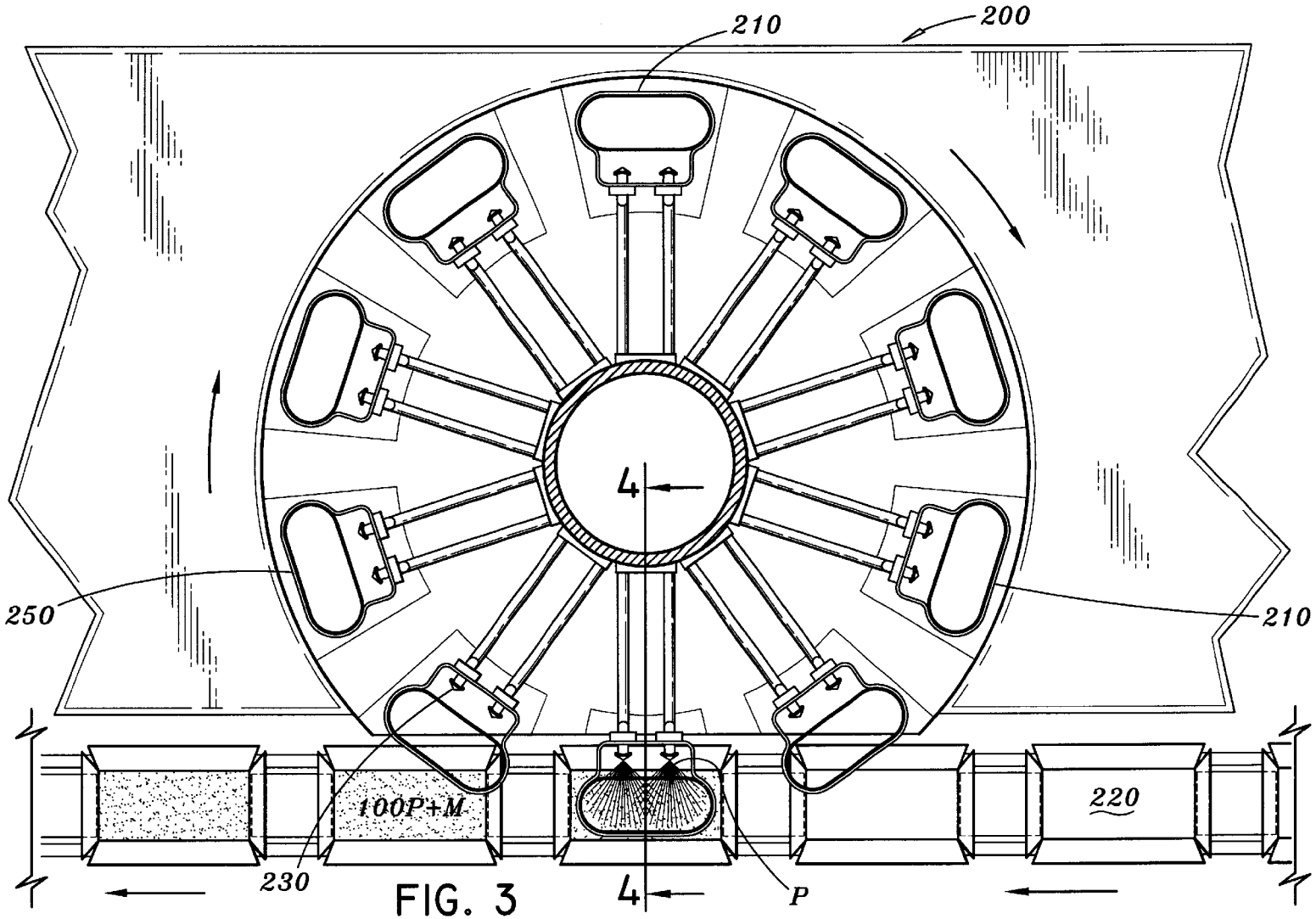
FIG. 3 illustrates an alternate, improved powdered detergent manufacturing process.

Turning now to FIG. 3, an alternative improved powdered detergent manufacturing process is shown. Apparatus of 200 of FIG. 3 is a rotary filler machine. With reference to FIG. 2, this apparatus would replace that which is shown subsequent to vessel 70, i.e., powder 100M would be transported to rotary filler 200 for subsequent filling into final containers. Rotary filler 200 includes a plurality of filling stations 210 that preferably rotate in a clockwise direction so as to alternately dispose filling stations 210 over containers 220. Ultra-sonic spray nozzles 230 are shown associated with each filling station 210. Alternately, it is possible to mount a single, stationary spray applicator at the location of the powder transfer to containers 220 and have that applicator apply perfume or other volatile liquids as each filling station rotates into place. This would eliminate the need for multiple perfume applicators.

Figure 4:
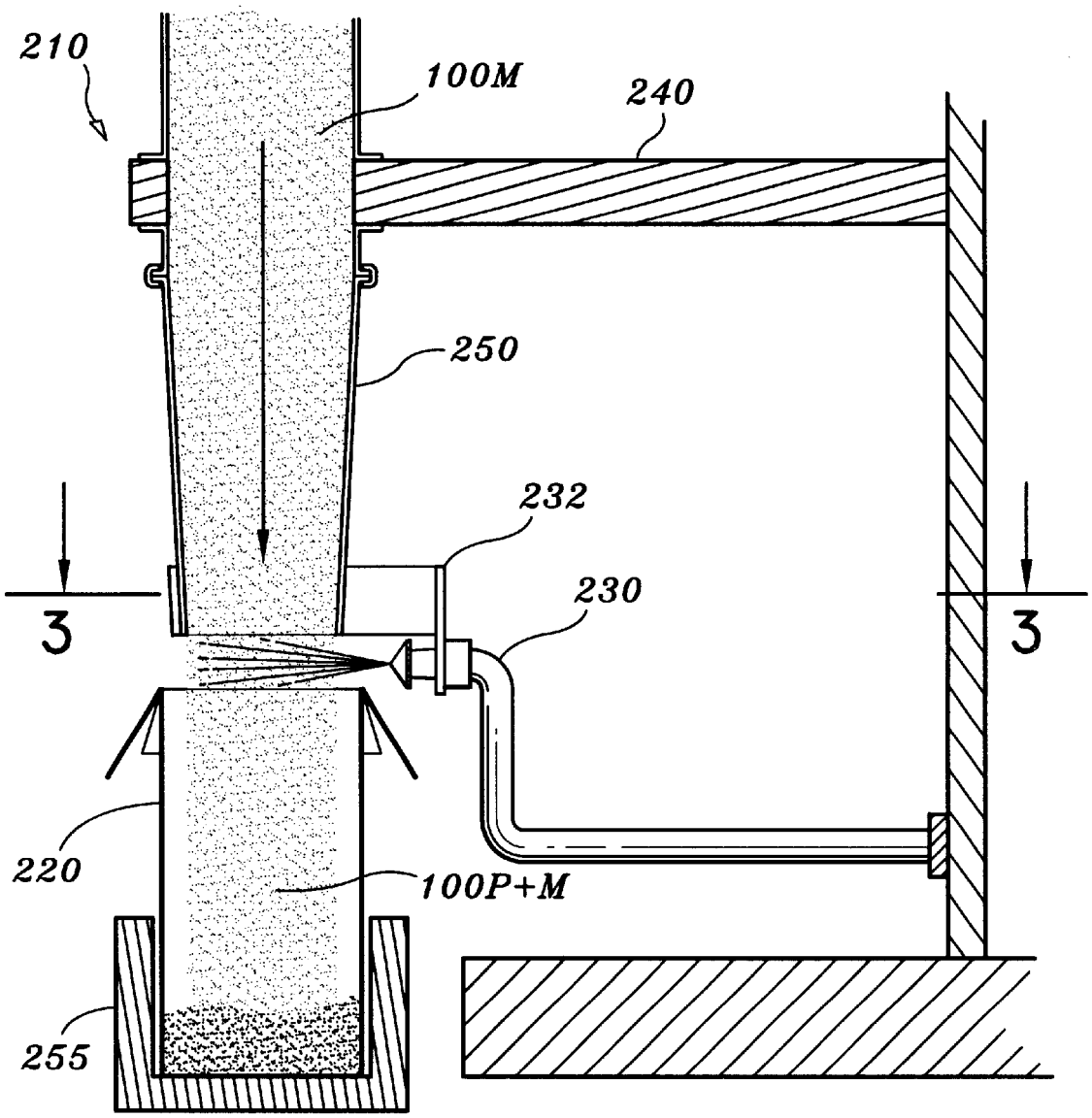
FIG. 4 illustrates a preferred location for placing a perfume applicator.

Turning to FIG. 4, a cross sectional view of the FIG. 3 filling apparatus is shown. Filling station 210 is shown having support 240 holding funnel section 250. Spray applicator 230 is mounted to a lower portion of funnel 250 so as to direct perfume onto powder 100M after it falls through funnel 250 into and before entering box 220. Box 220 is directed along conveyer 255 to facilitate the filling process. In a most preferred embodiment, volumetric or weight measurement signals would control the amount of powder that falls through funnel 250 into container 220. By knowing the amount of powder to be placed in each container, the desired amount of volatile substance can be applied.

Figure 5:
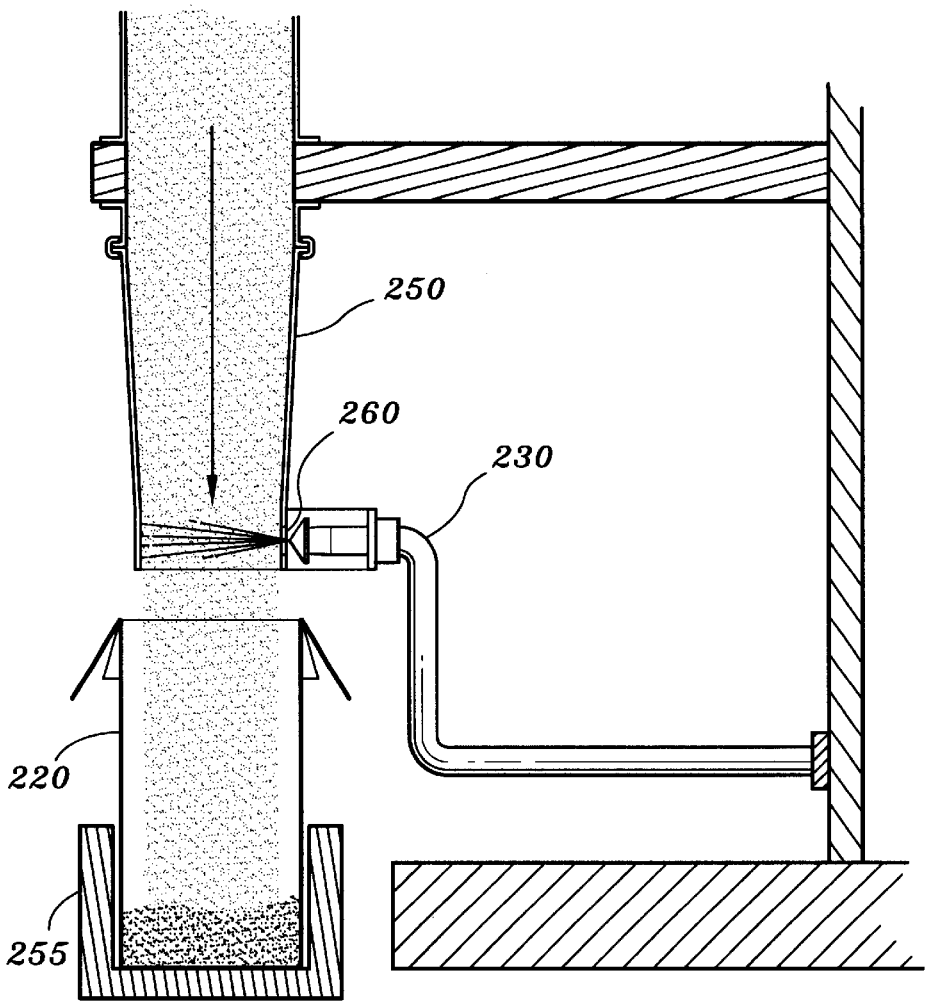
FIG. 5 illustrates an alternate, preferred location for placing a perfume applicator.
Figure 6:
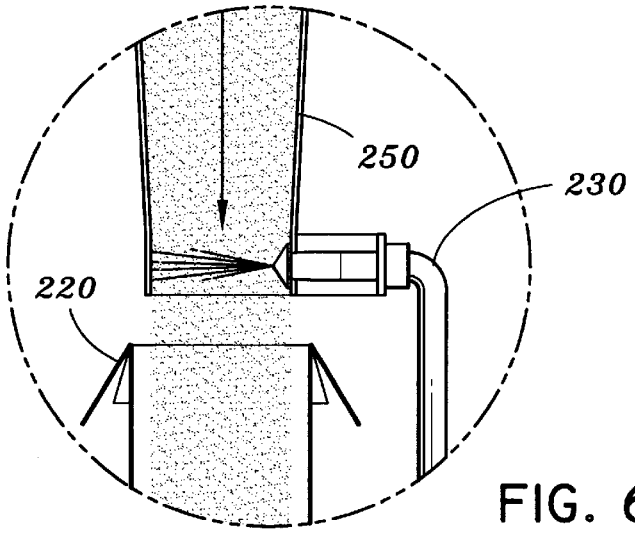
FIG. 6 illustrates an alternate, preferred location for placing a perfume applicator.

Turning to FIGS. 5 and 6, alternate preferred embodiments of mounting spray nozzles 230 to a rotary filling process are disclosed. With reference to FIG. 5, spray nozzle 230 is attached to the base of funnel 250 and sprays through orifice 260 in funnel 250. Alternatively, with reference to FIG. 6, the end of the spray nozzle can be mounted within funnel 250. In either of the embodiments of FIGS. 5 and 6, the spray nozzle 230 can be mounted at any point along the funnel, i.e., it need not be at the bottom of funnel 250.

By applying some or all of the perfume towards the end of the process, significantly less perfume is lost to the atmosphere. In addition, by decreasing the amount of perfume that is lost to the atmosphere, a wider variety of perfume agents can be retained on the final product. For example, significant amounts of perfumes having a relatively high volatility, until now, would be lost to the atmosphere and not make it to the final boxed product. However, by the present procedure, high note volatility perfumes can be included in the powdered detergent and delivered to the customer. This process, therefore, allows for a much greater variety of perfumes to be used. Also, as indicated above, other volatile agents can be applied using the process described herein. The processes described herein also allows for greater manufacturing efficiency and flexibility by adding product specific volatile agents towards the end of the process. With this processing advantage, cleaning requirements are reduced and common base powders (100+M) can be manufactured and stored in bulk for later packaging.

Although the illustrative embodiments of the present disclosure have been described herein with reference to the accompanying drawings, it is to be understood that the invention is not limited to those precise embodiments and that various other changes and modifications may be affected therein by one skilled in the art without departing from the scope and spirit of the disclosure.

What is claimed is:

1. A process for manufacturing detergent powder comprising:

providing detergent base powder;

providing an apparatus for mixing the base powder;

transferring the base powder to the mixing apparatus;

mixing the base powder in the mixing apparatus;

transferring the base powder to a packaging apparatus;

thereafter weighing the base powder in amounts suitable for filling in individual product containers;

providing a volatile ingredient; and applying the volatile ingredient to the weighed base powder prior to releasing the powder into final individual product containers.

2. The process according to claim 1, wherein the step of providing the volatile ingredient comprises providing at least one perfume ingredient.

3. The process according to claim 1, wherein the step of providing the mixing apparatus comprises providing a fluidized bed.

4. The process according to claim 1, wherein the step of applying the volatile ingredient comprises providing at least one spray nozzle and using the at least one spray nozzle to apply the volatile ingredient to the detergent base powder.

5. The process according to claim 4, wherein the step of providing the at least one spray nozzle comprises providing at least one ultra-sonic spray nozzle.

* * * * *

UNITED STATES PATENT AND TRADEMARK OFFICE
Certificate

Patent No. 6,458,756 B1 Patented: October 1, 2002

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: William Karpusiewicz, Washingtonville, NY; Roy Dennis Ray, Cartersville, GA; Philip Glassman, Monroe, CT; and John Lovas, Kearny, NJ.

Signed and Sealed this Eighteenth Day of October 2005.

YOGENDRA N. GUPTA
*Supervisory Patent Examiner*
Art Unit 1751